US005982406A

United States Patent [19]

Kawase

[11] Patent Number: 5,982,406

[45] Date of Patent: Nov. 9, 1999

[54] THERMAL TRANSFER PRINTER AND PRINT-START CONTROL METHOD

[75] Inventor: Hideo Kawase, Iwate-ken, Japan

[73] Assignee: Alps Electric Co., Ltd., Tokyo, Japan

[21] Appl. No.: 09/010,265

[22] Filed: Jan. 21, 1998

[30] Foreign Application Priority Data

Jan. 23, 1997 [JP] Japan ..... 9-010204

[51] Int. Cl.[6] ..... B41J 2/365

[52] U.S. Cl. ..... 347/194

[58] Field of Search ..... 347/188, 194; 400/120.09, 120.14

[56] References Cited

FOREIGN PATENT DOCUMENTS 4-103367 4/1992 Japan .

5-8423 1/1993 Japan .

768826 3/1995 Japan .

*Primary Examiner*—Huan Tran

*Attorney, Agent, or Firm*—Brinks Hofer Gilson & Lione

[57] ABSTRACT

A thermal transfer printer comprises a temperature detector which detects the temperature of a thermal head, a heating controller which performs heating processing on the thermal head to increase the thermal head temperature to a temperature higher than a print-permit temperature, a heat radiation controller which performs heat radiation processing on the thermal head to reduce the thermal head temperature to the print-permit temperature, and a control unit which controls a temperature slope of the thermal head to be a descending slope to be the print-permit temperature by radiating heat from the thermal head. The thermal transfer printer obtains an excellent print result.

5 Claims, 3 Drawing Sheets

THERMAL TRANSFER PRINTER AND PRINT-START CONTROL METHOD

BACKGROUND OF THE INVENTION

1. Field of the Invention

This invention relates to a thermal transfer printer and a print-start control method which apply print energy to a thermal head to heat the thermal head, so as to perform printing by transferring ink on a heat-melt type ink ribbon or a thermal-sublimation type ink ribbon onto a print sheet.

2. Description of Prior Art

A thermal transfer printer performs printing for one line by moving a carriage, on which a thermal head is mounted, along a platen, and after the one-line printing, feeding a print sheet for one line and performing printing for the next line. Thus, the thermal transfer printer performs a predetermined printing by repeating the above operations. This printer is widely used as an output device for a computer, a word processor and the like by virtue of high-quality printing, low noise, low cost, simple maintenance and the like.

In the thermal transfer printer, the carriage is movable along the platen, and the thermal head having a plurality of arrayed heat generating elements is mounted on the carriage, further, a ribbon cassette containing a desired color ink ribbon is removably attached to the carriage. The ink ribbon fed from the ribbon cassette and a print sheet are held between the platen and the thermal head, then the thermal head with the carriage is moved along the platen, while the ink ribbon is reeled up, on the other hand, the heat generating elements of the thermal head are selectively electrify-driven based on image information to generate heat, thus desired printing is performed by partially transferring the ink on the ink ribbon onto the print sheet.

Generally, the thermal transfer printer performs printing by using a heat-melt type ink ribbon, formed by coating a substrate of a plastic film or the like with heat-melt type ink, as the ink ribbon. Recently, a thermal transfer printer which performs printing by using a thermal-sublimation type ink ribbon, formed by coating the above substrate with thermal-sublimation type ink, has also been proposed.

The thermal transfer printer, which performs printing by using the heat-melt type ink ribbon, can perform printing on various types of paper such as a normal print sheet, a cardboard and a post card, thus can be used for various purposes. Further, the thermal transfer printer, which performs printing by using the thermal-sublimation type ink ribbon, uses a special paper having a processed surface, and controls the amount of ink sublimation to control an ink amount transferred onto the special paper, by controlling energy applied to the thermal head, for density control of printed image on the special paper, thus obtains a high-quality full color image which is a good match for a silver-chloride photograph. For this feature, in recent years, the thermal-sublimation type printer has been widely used as a high image-quality video printer or the like.

Further, in recent years, a thermal transfer printer corresponding to both heat-melt type ink ribbon and thermal-sublimation type ink ribbon has been proposed.

However, this thermal transfer printer has the following problem. For example, immediately after print start, if the temperature of the thermal head has not risen to a temperature to permit ink transfer from the ink ribbon onto a print sheet, even though the heat generating elements of the thermal head are selectively caused to generate heat, an excellent printing is not obtained.

To prevent this inconvenience, it has been considered to perform control such that before print start, the heat generating elements of the thermal head are heated in advance.

However, the conventional print temperature control simply heats the thermal head before print start, and only determines whether or not the thermal head temperature has become a print-enable temperature or higher. If the thermal head temperature is higher than the print-enable temperature, printing is started. However, in this control, even if the thermal head temperature is too high to perform printing, the above control cannot determine this situation. Further, occasionally, printing is performed when the thermal head temperature is further increasing. In any way, printing after such determination of the thermal head temperature might not obtain an excellent result.

Especially, in printing using the thermal-sublimation type ink ribbon, the sublimation amount of the thermal-sublimation type ink is controlled by heat generation of the heat generating elements of the thermal head to control the ink amount transferred onto the print sheet. To obtain an excellent print result, management of the thermal head temperature in printing is necessary.

SUMMARY OF THE INVENTION

The present invention has its object to provide a thermal transfer printer and a print-start control method which perform temperature control on a thermal head of the thermal transfer printer in printing, to obtain an excellent printing.

Another object of the present invention is to detect the temperature of the thermal head of the thermal transfer printer upon print start, and if the detected thermal head temperature is equal to or lower than a print-permit temperature, heat the thermal head so as to temporarily increase the thermal head temperature to a temperature higher than the print-permit temperature, and thereafter, perform heat radiation of the thermal head to cause the temperature to have a descending slope, to obtain a print-permit temperature.

Other objects and advantages besides those discussed above shall be apparent to those skilled in the art from the description of a preferred embodiment of the invention which follows. In the description, reference is made to accompanying drawings, which form a part thereof, and which illustrate an example of the invention. Such example, however, is not exhaustive of the various embodiments of the invention, and therefore reference is made to the claims which follow the description for determining the scope of the invention.

BRIEF DESCRIPTION OF THE DRAWINGS

The accompanying drawings, which are incorporated in and constitute a part of the specification, illustrate embodiment of the invention and, together with the description, serve to explain the principles of the invention.

DETAILED DESCRIPTION OF THE PREFERRED EMBODIMENT

A preferred embodiment of the present invention will now be described in detail in accordance with the accompanying drawings.

Figure 1:
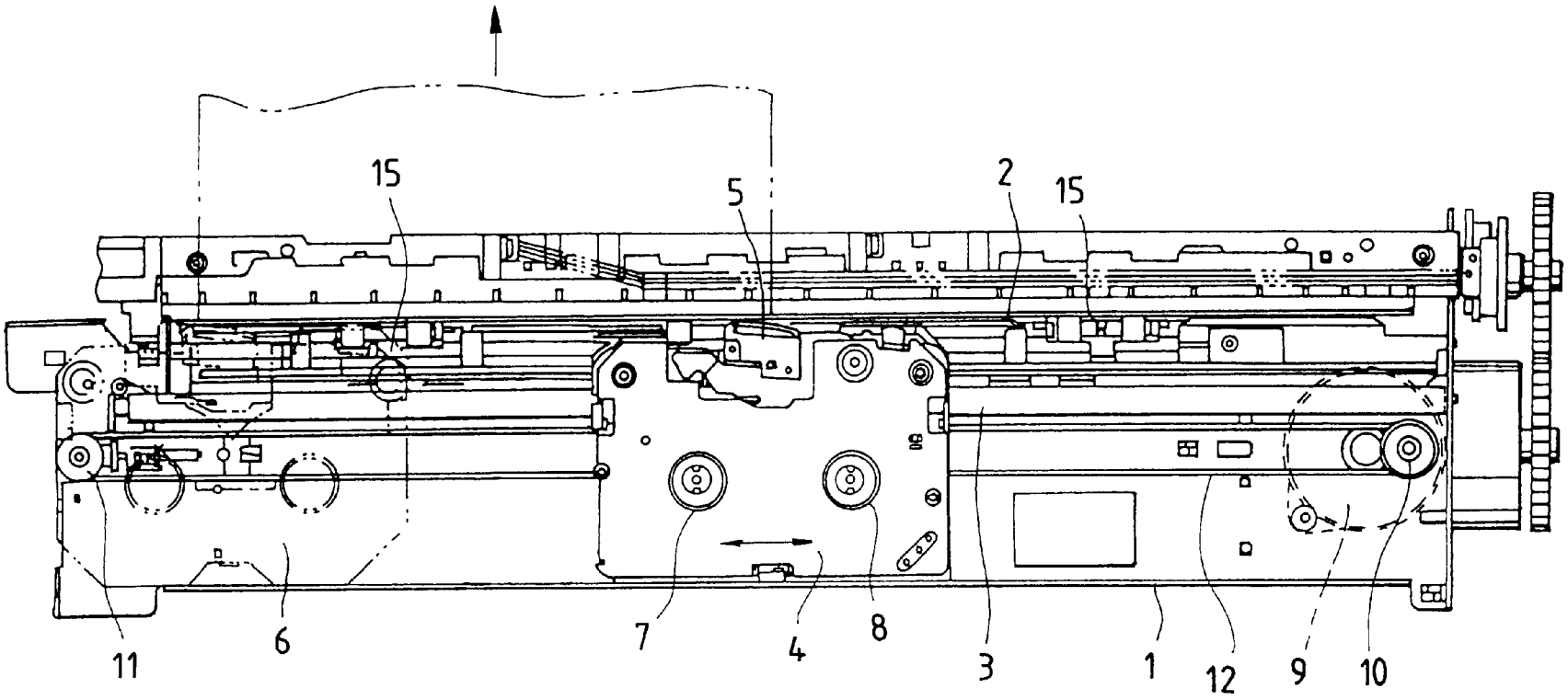
FIG. 1 is a plan view showing the schematic structure of a thermal transfer printer according to an embodiment of the present invention.

FIG. 1 is a plan view showing the schematic structure of a thermal transfer printer according to an embodiment of the present invention. In the printer, a flat-plate platen 2 extending along a longitudinal direction is provided on a frame 1, and a carriage shaft 3, positioned in front of the platen 2, extending parallel to the platen 2, is supported between the parallel sides of the frame 1. A carriage 4, which can reciprocate along the carriage shaft 3, is attached to the carriage shaft 3. A thermal head 5 as a recording head is detachably attached to the tip of the carriage 4 such that the thermal head 5 is opposite to the platen 2. Further, a ribbon cassette 6, containing an ink ribbon (not shown) and guiding the ink ribbon between the thermal head 5 and the platen 2, is removably attached on the upper surface of the carriage 4. Further, a reel bobbin 7 for reeling up the ink ribbon from the ribbon cassette 6 and a feed bobbin 8 for feeding the ink ribbon are respectively provided on the upper surface of the carriage 4.

On the lower surface at one end of the frame 1, a carriage drive motor 9 is provided such that its output shaft penetrates the frame 1 to the upper surface of the frame 1. A drive pulley 10 rotate-driven by the carriage drive motor 9 is provided on the output shaft of the carriage drive motor 9. Further, on the upper surface at the other end of the frame 1, a driven pulley 11 is rotatably provided, and a carriage drive belt 12, a part of which is connected to the lower surface of the carriage 4, is extended around the drive pulley 10 and the driven pulley 11. By rotate-driving the carriage drive motor 9 to drive the carriage drive belt 12 via the drive pulley 10, the carriage 4 is reciprocated along the carriage shaft 3, parallel to the platen 2.

Figure 2:
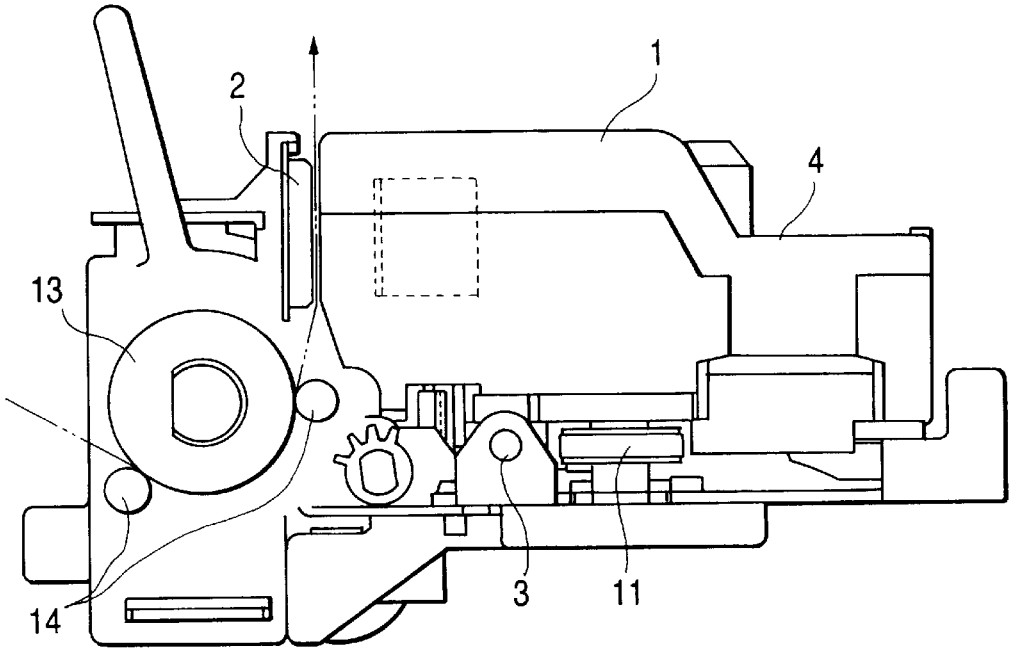
FIG. 2 is a cross-sectional view of the thermal transfer printer in FIG. 1.

As shown in FIG. 2, a conveyance roller 13 for conveying a predetermined print medium at a predetermined speed is provided at a low position in the rear of the platen 2. Further, a plurality of press-contact rollers 14, pressed against the conveyance roller 13, are rotatably provided under the conveyance roller 13. Further, a paper feed device (not shown) is provided in the rear of the frame 1. The paper feed device contains reading media such as documents and print media such as normal print sheets, stencil print sheets and the like. By rotate-driving the conveyance roller 13, the document and the print medium supplied from the paper feed device between the conveyance roller 13 and the press-contact rollers 14 are conveyed between the thermal head 5 and the platen 2. Further, a paper discharge roller 15 for guiding the print medium after printing is provided above the platen 2.

Figure 3:
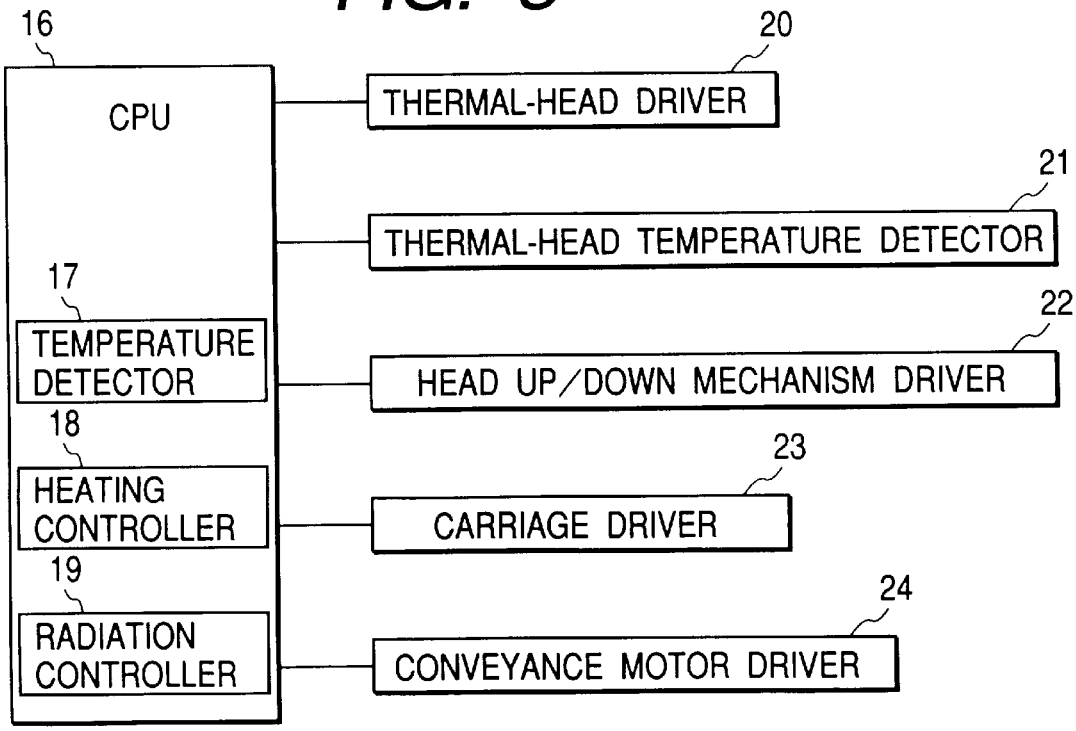
FIG. 3 is a block diagram showing the schematic electrical construction of the thermal transfer printer according to the present embodiment.

FIG. 3 shows the schematic electrical construction of the thermal transfer printer.

In the thermal transfer printer, all the print controls are performed by a CPU 16 as control means. The CPU 16 inputs a print-start signal, print data and the like from an input device such as a computer via an interface, and sends print pattern information to a thermal-head driver 20. Then energy is applied to the heat generating elements of the thermal head 5 in accordance with the print information. Further, the CPU 16 sends control signals to a thermal-head temperature detector 21 which detects the temperature of the thermal head 5, a head up/down mechanism driver 22 for a head up/down mechanism which performs press-contact and separation between the thermal head 5 and the print medium, a carriage driver 23 which controls the movement of the carriage 4, and a conveyance motor driver 24 which drives the conveyance motor to feed the print medium.

Further, in the present embodiment, the CPU 16 has a temperature detector 17 which detects the temperature of the thermal head 5, a heating controller 18 which performs heating processing on the thermal head to increase its temperature to a temperature higher than a print-permit temperature, and a heat radiation controller 19 which performs heat radiation processing on the thermal head 5 to reduce its temperature to the print-permit temperature. The CPU 16 performs radiation of the thermal head temperature to cause the temperature to have a descending slope to be the print-permit temperature.

Figure 4:
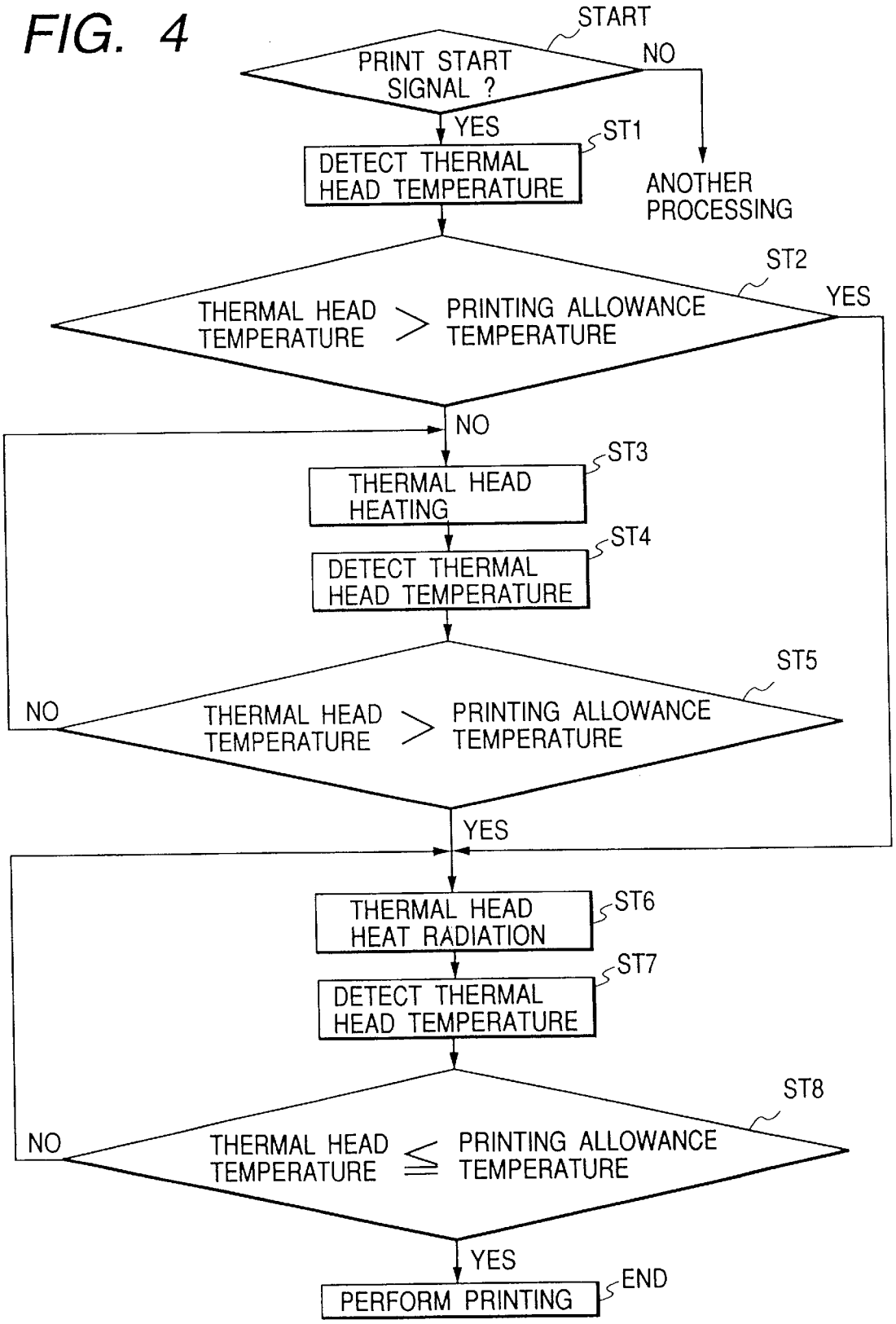
FIG. 4 is a flowchart showing a print-start control method for the thermal transfer printer according to the present embodiment.

Next, a print-start control method for the thermal transfer printer according to the present embodiment will be described with reference to the flowchart of FIG. 4.

In the thermal transfer printer having the above construction, the CPU 16 first detects the temperature of the thermal head 5 (step ST1) by the temperature detector 17 via the thermal-head temperature detector 21, upon reception of a print-start signal transmitted from the input device such as a computer, as a print start condition.

Then, the detected temperature of the thermal head 5 is compared with a print-permit temperature stored in a ROM (not shown) of the CPU 16 (step ST2). If the temperature of the thermal head 5 is lower than the print-permit temperature (NO at step ST2), heating processing is performed by the heating controller 18 on the thermal head 5 (step ST3).

The heating processing by the heating controller 18 is made by applying energy to the heat generating elements of the thermal head 5 in a state where the thermal head 5 is not in contact with the platen 2 (so-called head-up state) . Then, the temperature of the thermal head 5 is detected by the temperature detector 17 via the thermal-head temperature detector 21 (step ST4), and it is determined whether or not the detected temperature is higher than the print-permit temperature (step ST5). The heating processing (step ST3) on the thermal head 5 by the heating controller 18 to the determination as to whether or not the detected temperature is higher than the print-permit temperature (step ST5) are repeated until the detected temperature has become higher than the print-permit temperature.

On the other hand, upon thermal-head temperature detection immediately after the reception of the print-start signal (step ST1), if the temperature of the thermal head 5 is already higher than the print-permit temperature (YES at step ST2), the series of processes from step ST3 to step ST5 performed on the thermal head 5 by the heating controller 18 are omitted.

Next, heat radiation processing is performed on the thermal head 5, already having the temperature higher than the print-permit temperature, by the heat radiation controller 19, so as to reduce the temperature of the thermal head 5 to the print-permit temperature (step ST6). The heat radiation processing by the heat radiation controller 19 is made by stopping all the operations to the thermal head 5 and radiating the heat of the thermal head 5. At this time, it may be arranged such that the carriage 4 holding the thermal head 5 is moved along the platen 2, and heat radiation is promoted by utilizing wind caused by the movement of the carriage 4.

Next, the temperature of the thermal head 5 is detected (step ST7) by the temperature detector 17 via the thermal-head temperature detector 21, and it is determined whether or not the detected temperature is equal to or lower than the print-permit temperature (step ST8). The process operations from the heat radiation processing (step ST6) on the thermal head 5 by the heat radiation controller 19 to the determination as to whether or not the detected temperature is equal to or lower than the print-permit temperature (step ST8) are repeated until the detected temperature has become equal to or lower than the print-permit temperature.

When the CPU 16 detects that the temperature of the thermal head 5 has decreased to the print-permit temperature or lower, transmits control signals to the thermal-head driver 20, the carriage driver 23, the conveyance motor driver 24 and the like, based on the print data transmitted from the input device such as a computer, thus performs a desired printing.

In this manner, upon print start, temperature control is performed on the thermal head 5 to cause the temperature of the thermal head 5 to have a descending slope, and printing is started when it is detected that the thermal-head temperature has become the print-permit temperature, which prevents inconveniences that the temperature of the thermal head 5 is inappropriately high for printing or printing is performed even though the temperature has an ascending slope to be an inappropriately higher temperature for printing. Accordingly, an excellent print result can be reliably obtained.

This characteristic feature is especially advantageous in printing by using a thermal-sublimation type ink ribbon, in which the density of a print image is controlled by controlling the amount of ink transferred onto a print sheet by controlling the sublimation amount of the thermal-sublimation type ink.

Note that the present invention is not limited to the above embodiment but various changes can be made in accordance with necessity.

As described above, according to the thermal transfer printer and print-start control method of the present invention, a thermal transfer printer which reliably obtains a desired print result with simple control can be provided at a low price.

As many apparently widely different embodiments of the present invention can be made without departing from the spirit and scope thereof, it is to be understood that the invention is not limited to the specific embodiments thereof except as defined in the appended claims.

What is claimed is:

1. A thermal transfer printer, comprising:

a platen;

a carriage which reciprocates along said platen;

a thermal head, mounted on said carriage, and pressed onto said platen across an ink ribbon and a print medium;

a temperature detector which detects a temperature of said thermal head; and a control unit that controls printing by raising the temperature of said thermal head to a temperature level not lower than a predetermined print-permit temperature when the temperature of said thermal head detected by said temperature detector is not higher than said predetermined print-permit temperature and allowing the temperature of said thermal head to decrease from said temperature level to a level not higher than said print-permit temperature, thereby creating a descending gradient of temperature of said thermal head immediately before the start of printing.

2. The thermal transfer printer of claim 1, wherein said control unit comprises a heating controller which performs heating processing on said thermal head to increase the temperature to said temperature level not lower than said predetermined print-permit temperature.

3. The thermal transfer printer of claim 2, wherein said control unit comprises a heat radiation controller which performs heat radiation processing on said thermal head to decrease the temperature of said thermal head from said temperature level to said print-permit temperature.

4. The thermal transfer printer of claim 1, wherein said control unit comprises a heat radiation controller which performs heat radiation processing on said thermal head to decrease the temperature of said thermal head from said temperature level to said print-permit temperature.

5. A thermal transfer printer, comprising:

a platen;

a carriage which reciprocates along said platen;

a thermal head, mounted on said carriage, and pressed onto said platen across an ink ribbon and a print medium;

a temperature detector which detects a temperature of said thermal head; and a print start control unit that, upon receipt of a print start signal as a print start condition, causes said temperature detector detect the temperature of said thermal head and, wherein said print start control raises the temperature of said thermal head to a temperature level above a predetermined print-permit temperature when the temperature of said thermal head detected by said temperature detector is not higher than said predetermined print-permit temperature and allows the temperature of said thermal head to decrease from said temperature level to said print-permit temperature where printing starts, and wherein should the temperature of said thermal head detected by said temperature detector at the time of receipt of said print start signal be not lower than said print-permit temperature, said print start control unit does not raise the temperature of said thermal head but allows the temperature of the thermal head to decrease from the temperature of said thermal head detected by said temperature detector at the time of receipt to said print-permit temperature, wherein printing is started only upon the temperature of said thermal head detected by said temperature detector reaching said print-permit temperature and a descending gradient of temperature of said thermal head is created immediately before the start of printing.

* * * * *

UNITED STATES PATENT AND TRADEMARK OFFICE

CERTIFICATE OF CORRECTION

PATENT NO. : 5,982,406

DATED : November 9, 1999

INVENTOR(S) : Hideo Kawase

It is certified that error appears in the above-identified patent and that said Letters Patent is hereby corrected as shown below:

In claim 5, line 11, after "detector" please insert --to--.

Signed and Sealed this

Fourteenth Day of November, 2000

*Attest:*

Q. TODD DICKINSON

*Attesting Officer*

*Director of Patents and Trademarks*